US009249604B2

(12) United States Patent
Tseng

(10) Patent No.: US 9,249,604 B2
(45) Date of Patent: Feb. 2, 2016

(54) LOCKING AND INSERTION STRUCTURE

(71) Applicants: Inventec (Pudong) Technology Corporation, Shanghai (CN); INVENTEC CORPORATION, Taipei (TW)

(72) Inventor: Fan-Jung Tseng, Taipei (TW)

(73) Assignees: INVENTEC (PUDONG) TECHNOLOGY CORPORATION, Shanghai (CN); INVENTEC CORPORATION, Taipei (TW)

( * ) Notice: Subject to any disclaimer, the term of this patent is extended or adjusted under 35 U.S.C. 154(b) by 563 days.

(21) Appl. No.: 13/846,795

(22) Filed: Mar. 18, 2013

(65) Prior Publication Data

US 2014/0079481 A1 Mar. 20, 2014

(30) Foreign Application Priority Data

Sep. 17, 2012 (CN) ..... 2012 1 0347078

(51) Int. Cl.
*E05B 73/00* (2006.01)

(52) U.S. Cl.
CPC ..... *E05B 73/0082* (2013.01); *Y10T 403/7075* (2015.01)

(58) Field of Classification Search
CPC ..... E05B 73/0005; E05B 73/0082; Y10T 403/70; Y10T 403/75; Y10T 403/7062; Y10T 403/7075
See application file for complete search history.

(56) References Cited

U.S. PATENT DOCUMENTS

| | | | | |
|---|---|---|---|---|
| 5,104,163 | A * | 4/1992 | Palmer, Jr. | E05B 63/24 292/148 |
| 5,447,045 | A * | 9/1995 | Cheng | E05B 73/0005 248/552 |
| 6,095,574 | A * | 8/2000 | Dean | E05B 73/0082 292/164 |
| 6,622,532 | B2 * | 9/2003 | Hsu | E05B 73/0082 248/316.4 |
| 8,511,119 | B2 * | 8/2013 | Mazzucchelli | E05B 73/0017 24/704.1 |
| 2007/0157680 | A1 * | 7/2007 | DeMartinis | E05B 67/24 70/57 |
| 2012/0180271 | A1 * | 7/2012 | Avganim | A45C 3/02 24/385 |

* cited by examiner

*Primary Examiner* — Daniel Wiley
(74) *Attorney, Agent, or Firm* — Locke Lord LLP; Tim Tingkang Xia, Esq.

(57) ABSTRACT

A locking and insertion structure, applicable for an electronic device including a casing, includes a fastening element and a locking element. The casing includes a bottom part, a locking seat and a cantilever part. The fastening element includes a body disposed on the casing, a first locking part extending from the second locking part to between the cantilever part and the locking seat, and a second locking part extending from the body onto the cantilever part. The cantilever part is between the first and second locking part. A first locking hole of the first locking part, a second locking hole of the second locking part and a third locking hole of the cantilever part align with each other. The locking element penetrates through the second, third and first locking hole and is inserted into the locking seat sequentially so the fastening element is affixed to the casing.

10 Claims, 3 Drawing Sheets

LOCKING AND INSERTION STRUCTURE

CROSS-REFERENCE TO RELATED APPLICATIONS

This non-provisional application claims priority under 35 U.S.C. §119(a) on Patent Application No(s). 201210347078.1 filed in China on Sep. 17, 2012, the entire contents of which are hereby incorporated by reference.

BACKGROUND OF THE INVENTION

1. Field of the Invention

The disclosure relates to a locking and insertion structure, and more particularly to a locking and insertion structure disposed in an electronic device.

2. Description of the Related Art

In recent years, with the advances in technology, the use of electronic devices are becoming more and more popular and are being developed towards a compact design to provide better convenience. The electronic device, such as a laptop computer, a mobile phone or a personal digital assistant (PDA), has advantages in being lightweight and a smaller size, so that it is easy to carry. Therefore, these portable electronic devices are becoming popular.

However, although this kind of the electronic device has small in size and is easy to carry, it is easy to be improperly moved or stolen when user does not pay attention. Therefore, a locking structure, such as a Kensington Lock, may be disposed on a casing of the electronic device, and the electronic device is connected to an external lock via a locking hole of the locking structure. Typically, an end of the lock is connected to the locking hole and is fixed to the electronic device. The other end of the lock is placed on a fixing position, such as a table. Therefore, the user may lock the electronic device on the table to prevent the electronic device from being improperly moved or stolen.

Moreover, the locking structure is commonly disposed on an extra fixing component. The fixing component is fixed to the casing of the electronic device by a screw so as to expose the locking hole from the casing, such that the electronic device is affixed to the table by means of the locking hole connecting to the lock. In order to dispose the fixing component on the casing, conventionally, a copper nail having threads is inserted to the casing such that the screw is fixed in copper nail so as to fix the fixing element onto the casing. In order to provide a better fixing effect, the height of the copper nail (i.e., the depth of the inner thread) must be increased to a predetermined value. Therefore, the fixing manner of applying the screw to be fixed in the copper nail so as to fix the fixing element to the casing may not be applicable for the thinner electronic devices. Moreover, the structure including the copper nail that inserts into the casing increases the manufacturing cost.

SUMMARY OF THE INVENTION

An embodiment of the disclosure provides a locking and insertion structure, applicable for assembling into an electronic device including a casing. The casing includes a bottom part, a locking seat and a cantilever part. The locking seat is protruded from the bottom part, and the cantilever part is disposed on the locking seat. The locking and insertion structure comprises a fastening element and a locking element. The fastening element comprises a body, a first locking part and a second locking part. The body is disposed on the bottom part and is next to the locking seat. The second locking part is extended from the body onto the cantilever part. The first locking part is extended from the second locking part to between the cantilever part and the locking seat such that the cantilever part is sandwiched between the first locking part and the second locking part. The first locking part includes a first locking hole. The second locking part includes a second locking hole. The cantilever part includes a third locking hole. The first locking hole, the second locking hole and the third locking hole align with each other. The first locking hole includes a screw thread. The locking element penetrates through the second locking hole, the third locking hole, the first locking hole and is inserted into the locking seat in sequence such that the fastening element is affixed to the casing.

BRIEF DESCRIPTION OF THE DRAWINGS

The disclosure will become more fully understood from the detailed description given herein below for illustration only, and thus does not limit the disclosure, wherein.

DETAILED DESCRIPTION

Figure 1:
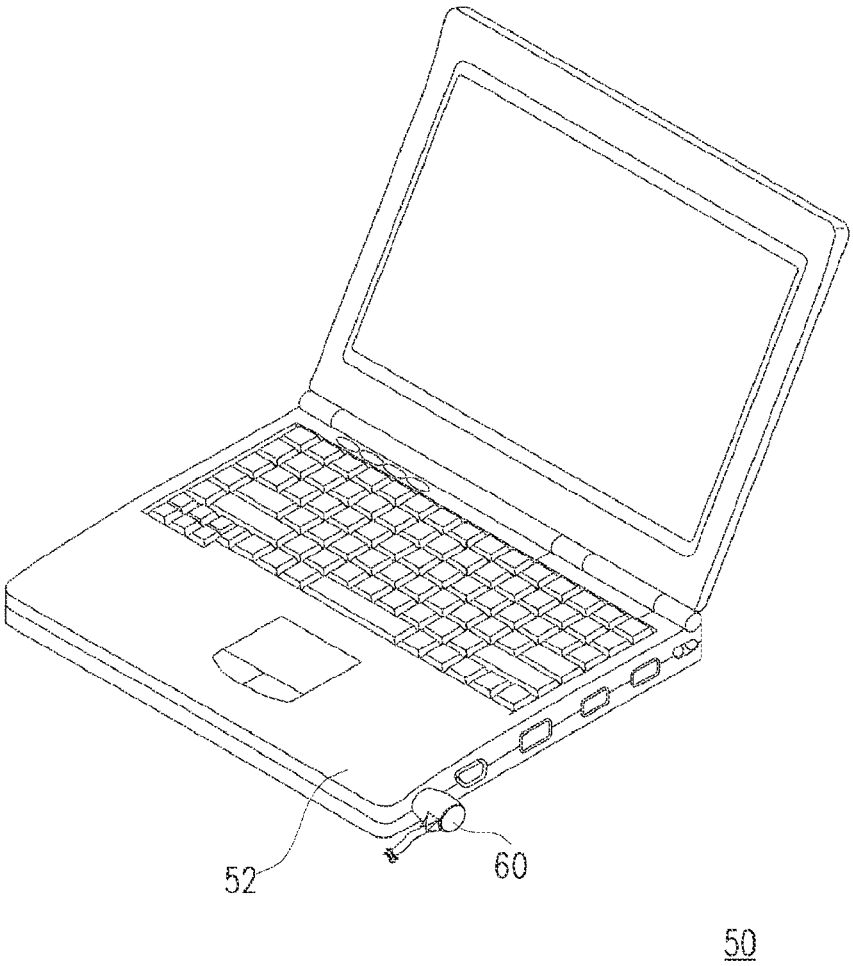
FIG. 1 is a perspective view of a locking and insertion structure applicable for an electronic device according to an embodiment of the disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
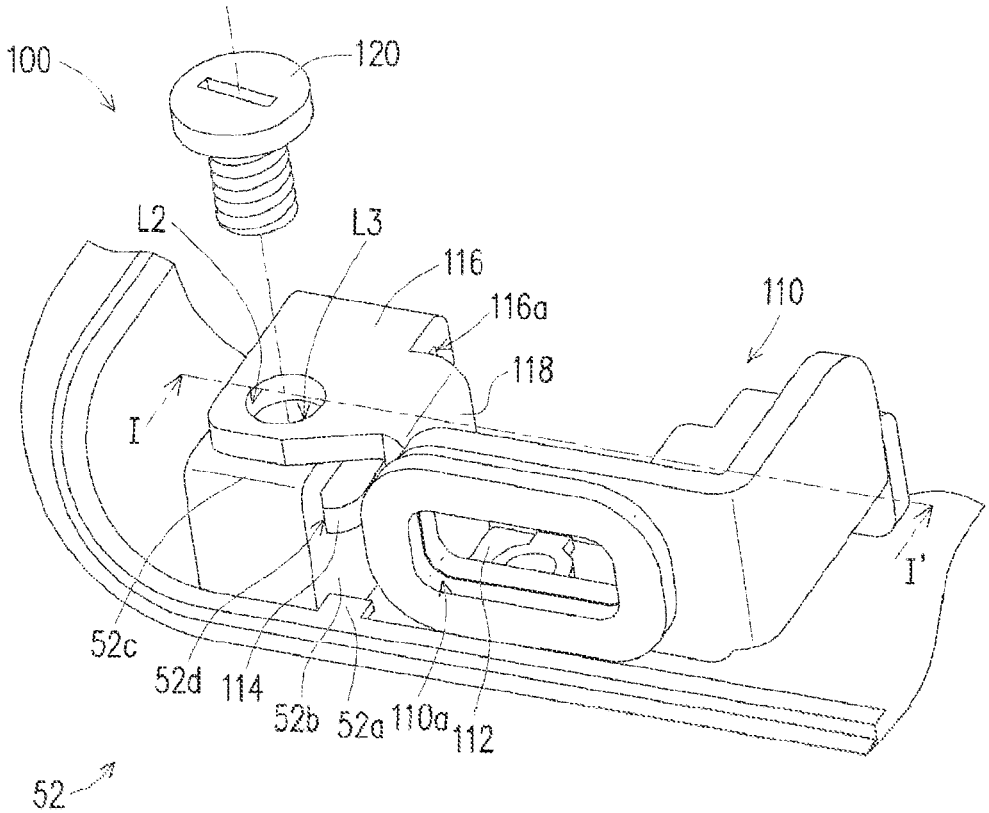
FIG. 2 is a partial view of the locking and insertion structure assembled in a casing in FIG. 1.

Please refer to FIGS. 1 and 2, FIG. 1 is a perspective view of a locking and insertion structure applicable for an electronic device according to an embodiment of the disclosure, and FIG. 2 is a partial view of the locking and insertion structure assembled in a casing in FIG. 1. In this embodiment, a locking and insertion structure 100 (only shown in FIG. 2), such as a Kensington Lock, is applicable for assembling in an electronic device 50. Therefore, the electronic device 50 is adapted for being affixed in a locking position, such as a table, by a lock 60.

Typically, in this embodiment, the electronic device 50 has a casing 52, and the locking and insertion structure 100 is disposed in the casing 52. The casing 52 has a bottom part 52*a*, a locking seat 52*b* and a cantilever part 52*c*. The locking seat 52*b* is protruded form the bottom part 52*a*. The cantilever part 52*c* is disposed on the locking seat 52*b*, and an embedded slot 52*d* is formed between the locking seat 52*b* and the cantilever part 52*c*. The locking and insertion structure 100 comprises a fastening element 110 and a locking element 120. For example, the locking element 120 is a screw. The fastening element 110 includes a locking hole 110*a*, and the lock 60 is adapted for penetrating through the casing 52 so as to be affixed to the locking hole 110*a* such that the electronic device 50 is connected to the lock 60 via the locking and insertion structure 100 so as to be affixed to the certain locking position.

Please refer to FIG. 2, in this embodiment, the fastening element 110 comprises a body 112, a first locking part 114 and a second locking part 116. The body 112 is disposed on the bottom part 52*a* and is next to the locking seat 52*b*. The locking hole 110*a* is disposed on the body 112. The second locking part 116 is extended from the body 112 onto the cantilever part 52*c*. The first locking part 114 is extended from the second locking part 116 to the embedded slot 52*d* which is between the cantilever part 52*c* and the locking seat 52*b*. Therefore, the first locking part 114 is regarded as being inserted (namely, embedded) into the embedded slot 52*d* such that the cantilever part 52*c* is sandwiched between (namely, is between) the first locking part 114 in the embedded slot 52*d* and the second locking part 116 on the cantilever part 52*c*. Moreover, the first locking part 114 includes a first locking hole L1, and the second locking part 116 includes a second locking hole L2. The first locking hole L1 includes threads.

Figure 3:
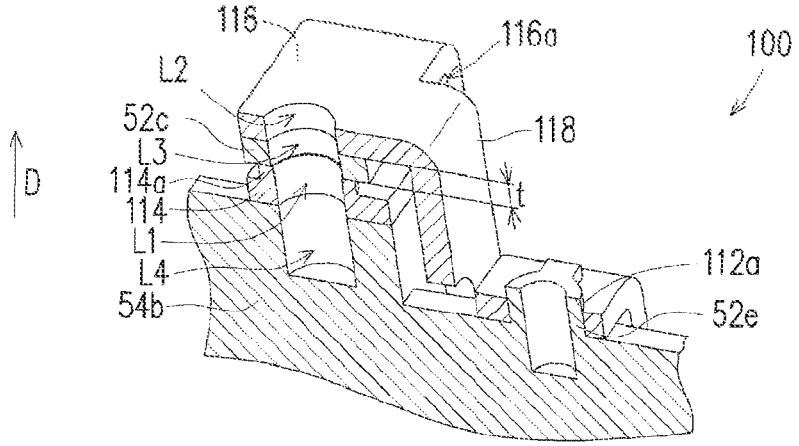
FIG. 3 is a cross-sectional view of the locking and insertion structure and the casing along a I-I' line in FIG. 3.
Figure 4:
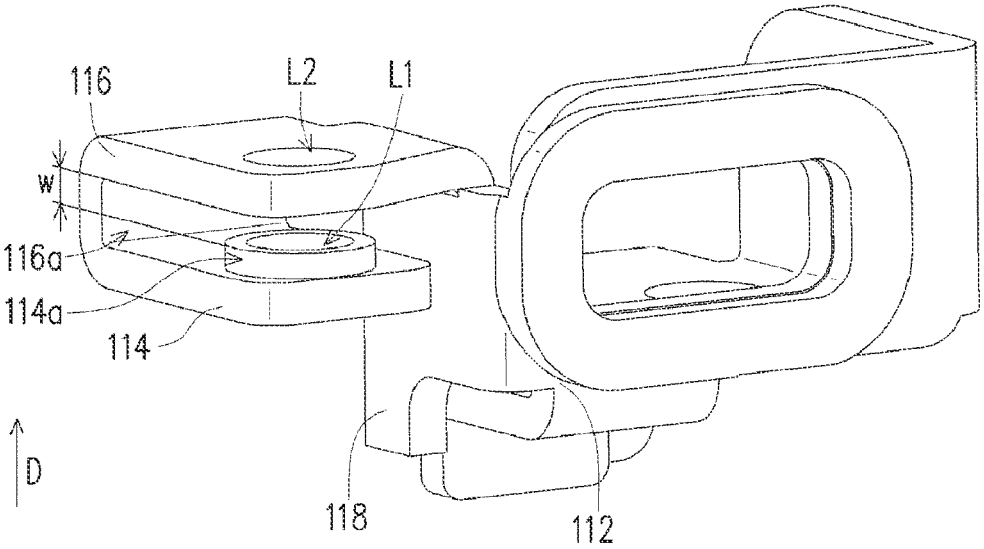
FIG. 4 is another perspective of the locking and insertion structure in FIG. 3.

Please refer to FIGS. 2 to 4, FIG. 3 is a cross-sectional view of the locking and insertion structure and the casing along a I-I' line in FIG. 3, and FIG. 4 is another perspective of the locking and insertion structure in FIG. 3. In this embodiment, the first locking part 114 is formed by bending one side of the second locking part 116 toward the locking seat 52*b* so as to form a channel 116*a* which is u shaped. The first locking part 114 is parallel to the second locking part 116, and the first locking hole L1 aligns with the second locking hole L2. When the first locking part 114 is inserted into the embedded slot 52*d* which is between the locking seat 52*b* and the cantilever part 52*c*, the cantilever part 52*c* is also inserted into the channel 116*a* between the first locking part 114 and the second locking part 116, as shown in FIG. 2.

Please refer to FIGS. 2 and 4. In this embodiment, the locking seat 52*b* is protruded from the bottom part 52*a* along a protruding direction D, and the cantilever part 52*c* is disposed on the locking seat 52*b*, such that the body 112 disposed on the bottom part 52*a* and the second locking part 116 disposed on the cantilever part 52*c* are disposed on different planes. Therefore, the fastening element 110 includes a connection part 118 which is adapted for connecting to the body 112 and the second locking part 116 which are on the different planes. In this embodiment, the connection part 118 is connected to the body 112 and the second locking part 116 along the protruding direction D of the locking seat 52*b*. Thus, the connection part 118 is perpendicular to the first locking part 114 as well as the second locking part 116, but is not limited to the disclosure.

On the other hand, in this embodiment, the cantilever part 52*c* includes a third locking hole L3. When the cantilever part 52*c* is inserted into the channel 116*a*, the first locking hole L1, the second locking hole L2 and the third locking hole L3 align with each other. Moreover, in this embodiment, the locking seat 52*b* includes a fourth locking hole L4. The fourth locking hole L4 aligns with the first locking hole L1, the second locking hole L2 and the third locking hole L3. In this embodiment, the first locking hole L1, the second locking hole L2 and the third locking hole L3 are through holes, and the fourth locking hole L4 is a blind hole (namely, without breaking through). Therefore, the locking element 120 is adapted for penetrating through the second locking hole L2, the third locking hole L3, the first locking hole L1 and the fourth locking hole L4 in sequence, and then is inserted into the locking seat 52*b*, such that the fastening element 110 is affixed to the casing 52. The threads of the locking element 120 are engaged with the threads of the first locking hole L1 to be affixed to each other.

In this embodiment, the material of the fastening element 110 is metal, such that the threads of the first locking hole L1 may be formed during a burring process of the fastening element 110. Therefore the manufacturing process of inserting a copper nail into the casing is avoided, and the locking and insertion structure is applicable for a casing thin-type of a thin-type electronic device. Moreover, in other embodiments, threads of the second locking hole L2 may be the same as those of the first locking hole L1, and the locking element 120 may be fixed with the first locking hole L1 and the second locking hole L2 at the same time, thereby enhancing the fixing between the fastening element 110 and the locking seat 52*b*. Moreover, in this embodiment, a flange 114*a* is formed in the surroundings of the first locking hole L1 by the burring process, thereby increasing the area of the threads in the first locking hole L1.

Please refer to FIGS. 3 and 4, in this embodiment, the width w of the channel 116*a* is a vertical distance between the flange 114*a* of the first locking part 114 and the second locking part 116. When the cantilever part 52*c* is inserted into the channel 116*a*, the flange 114*a* of the first locking part 114 abuts against the lower side of the cantilever part 52*c*, and the second locking part 116 abuts against the upper side of the cantilever part 52*c*, as shown in FIGS. 3 and 4. Therefore, the width of the channel 116*a* is substantially the same as the thickness of the cantilever part 52*c*, such that the cantilever part 52*c* is sandwiched between the first locking part 114 and the second locking part 116.

In other embodiments which are not shown in the drawings, because the first locking part does not include any flange, the width of the channel is the same as the vertical distance between the first locking part and the second locking part. When the cantilever part is inserted into the channel, the first locking part abuts against the lower side of the cantilever part, and the second locking part abuts against the upper side of the cantilever part. Therefore, the width of the channel is substantially the same as the thickness of the cantilever part, such that the cantilever part is sandwiched between the first locking part and the second locking part, but such is not limited to the disclosure.

On the other hand, please refer to FIG. 3, in this embodiment, the body 112 includes an opening 112*a*, and the casing 52 includes a protruding post 52*e* which is protruded from the bottom part 52*a*, such that the body 112 passes through the opening 112*a* and is sleeved onto the protruding post 52*e*. From the above mentioned, the material of the casing 52 in this embodiment is plastic. Therefore, a portion of the protruding post 52*e* which is protruded from the opening 112*a* is adapted for transformation by thermal melting, and the transformed portion of the protruding post 52*e* is laminated onto the body 112. Accordingly, the fastening element 110 is affixed to the casing 52 not only by the locking element 120 inserting the locking element 120 but also by the lamination of the protruding post 52*e* and the opening 112*a*.

To sum up, the disclosure provides the locking and insertion structure applicable for assembling in the electronic device. The locking and insertion structure, disposed on the casing of the electronic device, comprises the fastening element and the locking element. The cantilever part of the casing is sandwiched between the first locking part and the second locking part of the fastening element, and the first locking part, the second locking part and the cantilever part has a locking hole aligned with each other. The first locking hole of the first locking part has the threads. The locking element penetrates through these locking hole and then is inserted into the locking seat such that the fastening element is affixed to the casing. Moreover, the body of the fastening element includes the opening sleeved onto the protruding post of the casing. The portion of the protruding post protruded from the opening is adapted for transformation by hot melting and is laminated onto the body, such that the fastening element is affixed to the casing. Moreover, the fastening element includes a locking hole, and the lock is adapted for penetrating through the casing and is affixed to the locking hole such that the electronic device is connected to the lock via the locking and insertion structure to be affixed to the fixing position. Accordingly, a copper nail does not need to be disposed on the casing of the electronic device and to be penetrated by the locking element, such that the locking and insertion structure can be affixed to the casing without the copper nail, thereby reducing the size of the locking and insertion structure as well as the manufacturing cost.

What is claimed is:

1. A locking and insertion structure connected to an electronic device, the electronic device including a casing, the casing including a bottom part including a protruding post, a locking seat and a cantilever part, the locking seat being protruded from the bottom part adjacent the protruding post, and the cantilever part disposed on the locking seat, the locking and insertion structure comprising a fastening element comprising a body, a first locking part and a second locking part, the body disposed on the bottom part next to the locking seat and including an opening on a first side thereof receiving the protruding post, the second locking part being extended from a second side of the body onto the cantilever part, the first locking part extended from the second locking part to between the cantilever part and the locking seat such that the cantilever part is sandwiched between the first locking part and the second locking part, wherein the first locking part includes a first locking hole, the second locking part includes a second locking hole, the cantilever part includes a third locking hole, wherein the first locking hole, the second locking hole and the third locking hole align with each other, and the first locking hole includes a screw thread; and a locking element penetrating through the second locking hole, the third locking hole, the first locking hole and being inserted into the locking seat in sequence such that the fastening element is affixed to the casing;

wherein a portion of the protruding post protruded from the opening is deformed so as to fix the fastening element to the casing.

2. The locking and insertion structure according to claim 1, wherein the second locking hole includes threads and the third locking hole is a through hole.

3. The locking and insertion structure according to claim 1, wherein the locking seat includes a fourth locking hole aligned with the first locking hole, the second locking hole and the third locking hole, and the fourth locking hole is a blind hole.

4. The locking and insertion structure according to claim 1, wherein the first locking part and the second locking part form a channel together, the cantilever part is a cantilever protruding part, the channel is u-shaped, and the width of the channel is substantially the same as the thickness of the cantilever protruding part.

5. The locking and insertion structure according to claim 4, wherein the first locking part is formed by bending one side of the second locking part toward the locking seat.

6. The locking and insertion structure according to claim 1, wherein the fastening element further comprises a connection part connected to the body and the second locking part along a protruding direction of the locking seat.

7. The locking and insertion structure according to claim 6, wherein the first locking part and the second locking part are parallel to each other, and the connection part is perpendicular to the first locking part and the second locking part.

8. The locking and insertion structure according to claim 1, wherein the body is sleeved onto the protruding post via the opening, and the portion of the protruding post which is protruded from the opening is laminated onto the body by thermal melting.

9. The locking and insertion structure according to claim 1, wherein the fastening element includes a locking hole disposed on the body, and a lock is adapted for penetrating the casing to be affixed to the locking hole.

10. The locking and insertion structure according to claim 1, wherein a flange is disposed on the surrounding of the first locking hole and is used for increasing the area of the threads of the first locking hole.

* * * * *